US005140227A

United States Patent [19]

Dakin et al.

[11] Patent Number: 5,140,227

[45] Date of Patent: * Aug. 18, 1992

[54] STARTING AID FOR AN ELECTRODELESS HIGH INTENSITY DISCHARGE LAMP

[75] Inventors: James T. Dakin; Mark E. Duffy, both of Shaker Heights; Raymond A. Heindl, Euclid, all of Ohio

[73] Assignee: General Electric Company, Schenectady, N.Y.

[ * ] Notice: The portion of the term of this patent subsequent to Oct. 15, 2008 has been disclaimed.

[21] Appl. No.: 622,026

[22] Filed: Dec. 4, 1990

[51] Int. Cl.[5] ..... H05B 41/16

[52] U.S. Cl. ..... 315/248; 315/344; 313/234

[58] Field of Search ..... 315/248, 39, 344, 85, 315/348, 267; 313/234, 607

[56] References Cited

U.S. PATENT DOCUMENTS

| | | | |
|---|---|---|---|
| 4,810,938 | 3/1989 | Johnson | 315/248 |
| 4,902,937 | 2/1990 | Witting | 315/248 |
| 4,959,584 | 9/1990 | Anderson | 313/160 |

*Primary Examiner*—Eugene R. LaRoche
*Assistant Examiner*—A. Zarabian
*Attorney, Agent, or Firm*—George E. Hawranko; Stanley C. Corwin; Fred Jacob

[57] ABSTRACT

This electrodeless high intensity discharge lamp comprises a light-transmissive arc tube having spaced wall portions of dielectric material and a first gaseous fill within the arc tube. An excitation coil about the arc tube is energizable with RF current effective to develop a toroidal arc discharge in the first gaseous fill upon a dielectric breakdown of the fill. A starting container is joined to the arc tube and has an end wall constituted by one of arc-tube wall portions. A second gaseous fill within the starting container has a dielectric strength lower than that of the first gaseous fill. For initiating toroidal arc discharge, we provide an arrangement for producing a dielectric breakdown of the gaseous fill within the starting container that develops into an electric discharge that changes the potential at end wall in such a manner as to cause a dielectric breakdown of first gaseous fill.

4 Claims, 3 Drawing Sheets

STARTING AID FOR AN ELECTRODELESS HIGH INTENSITY DISCHARGE LAMP

FIELD OF THE INVENTION

The present invention relates generally to high intensity discharge (HID) lamps. More particularly, the present invention relates to an improved starting aid for an electrodeless HID lamp.

BACKGROUND OF THE INVENTION

In a high intensity discharge (HID) lamp, a medium to high pressure ionizable gas, such as mercury or sodium vapor, emits visible radiation upon excitation typically caused by passage of current through the gas via an arc discharge. One class of HID lamps comprises inductively coupled electrodeless lamps which develop and maintain an arc discharge by generating a solenoidal electric field in a high-pressure gaseous lamp fill. In such a lamp, the high pressure fill within an arc tube is initially broken down by an electric discharge, and the resulting discharge plasma is excited by radio frequency (RF) current in an excitation coil surrounding the arc tube. The arc tube and excitation coil assembly act essentially as a transformer which couples RF energy to the plasma. That is, the excitation coil acts as a primary coil, and the plasma functions as a single-turn secondary coil inductively coupled to the primary coil. RF current in the excitation coil produces a time-varying magnetic field, in turn creating an electric field in the plasma which substantially closes upon itself, i.e., a solenoidal electric field. Current flows as a result of this electric field, resulting in a toroidal arc discharge in the plasma within the arc tube.

The toroidal discharge in an inductively coupled HID arc tube is generally more difficult to start than the discharge in a conventional arc tube having electrodes serving as terminals for the discharge. There are several reasons for this. First, the absence of electrodes eliminates the beneficial role which electrodes often play in starting electroded arc tubes. For example, without the electrodes, there is no opportunity for electric field concentrations at the electrode tip and no opportunity for generating initial electrons by physical processes at the surface of the cathode electrode such as by thermionic emission, field emmission, or ion bombardment. Second, it is very difficult to inductively generate the very high electric fields required for breakdown of the relatively high-pressure fill gas within the arc tube. Third, we utilize as the buffer gas in our arc-tube fill a high pressure inert gas, rather than mercury. For example, in one embodiment of our invention, we utilize as the buffer gas within our arc-tube fill krypton or xenon having a room-temperature pressure of 250 torr or more. This inert-gas pressure is approximately ten times higher than the inert-gas pressure which is desirable for initial starting breakdown.

There have been a number of approaches tried or suggested for initiating the arc discharge in the high pressure inert gas arc-tube fill of an electrodeless lamp. One early approach involves lowering the gas pressure of the fill, for example, by first immersing the arc tube in liquid nitrogen so that the gas temperature is decreased to a very low value and then allowing the gas temperature to increase. As the temperature rises, an optimum gas density is momentarily reached for ionization, or breakdown, of the fill to occur so that an arc discharge is initiated. However, the liquid nitrogen method of widespread commercial use.

More recent approaches have involved the use of a variety of metallic "starting aids", which typically serve to increase the electric field for starting. These metallic starting aids are usually located outside the arc-tube envelope but in some cases have been starting electrodes which enter the arc-tube envelope through seals. Examples of such metallic starting aids are shown in U.S. Pat. Nos. 4,894,589-Borowiec, 4,894,590-Witting, 4,902,937-Witting, and in applications Ser. No. 417,404-Witting filed Oct. 5, 1989, Ser. No. 527,500-ElHamamsy et al filed May 23, 1990, Ser. No. 527,502-El-Hamamsy et al, filed May 23, 1990, Ser. No. 07/527,502 Roberts et al, filed May 23, 1990, all of which are assigned to the assignee of the present invention and are incorporated by reference in the present application.

There are some disadvantages in using a metallic starting aid. For example, if the metallic starting aid is of such a character that it remains in place during lamp operation, it may serve as a vehicle for a life-limiting mechanism such as sodium loss, degradation of the arc-tube envelope wall, or seal failure. On the other hand, if a metallic starting aid is of such a character that it is removed or withdrawn after starting, then the complications and expense involved in controlling such moving part are introduced into the lamp design. Furthermore, a movable starting aid tends to change the impedance matching requirements of the energizing circuit for the excitation coil.

OBJECTS OF THE INVENTION

A general object of this invention is to provide means for starting the inductively-coupled arc tube of an electrodeless lamp that is free of most of the above-described problems associated with metallic starting aids.

Another object is to utilize for starting the lamp an electric discharge established in a location externally of the arc tube for applying to the arc-tube wall a potential sufficient to initiate a dielectric breakdown within the gaseous fill of the arc tube.

SUMMARY

In carrying out the invention in one form, we provide an electrodeless HID lamp comprising a light-transmissive arc tube having spaced wall portions of dielectric material and a first gaseous fill within the arc tube. Disposed about the arc tube is an excitation coil energizable with radio frequency current that is effective to develop a toroidal arc discharge in the first gaseous fill upon a dielectric breakdown of this fill. A starting container of tubular configuration and primarily of dielectric material is joined to the arc tube and has an end wall that is constituted by one of said arc-tube wall portions. Within the starting container there is a second gaseous fill that has a dielectric strength substantially lower than that of the first fill under normal conditions prevailing immediately prior to start up of the lamp. The toroidal arc discharge within the arc tube is initiated by means producing a dielectric breakdown of the gaseous fill within the starting container, which breakdown develops into a discharge that extends along the length of said starting container and changes the potential at said end wall in such a manner as to increase the voltage present between said arc-tube wall portions sufficiently to trigger a dielectric breakdown of said first gaseous fill.

BRIEF DESCRIPTION OF FIGURES

For a better understanding of the invention, reference may be made to the following detailed description taken in connection with the accompanying drawings, wherein:

FIG. 1 depicts the lamp in its "run", or operating, mode.

DETAILED DESCRIPTION OF EMBODIMENT

Figure 1:
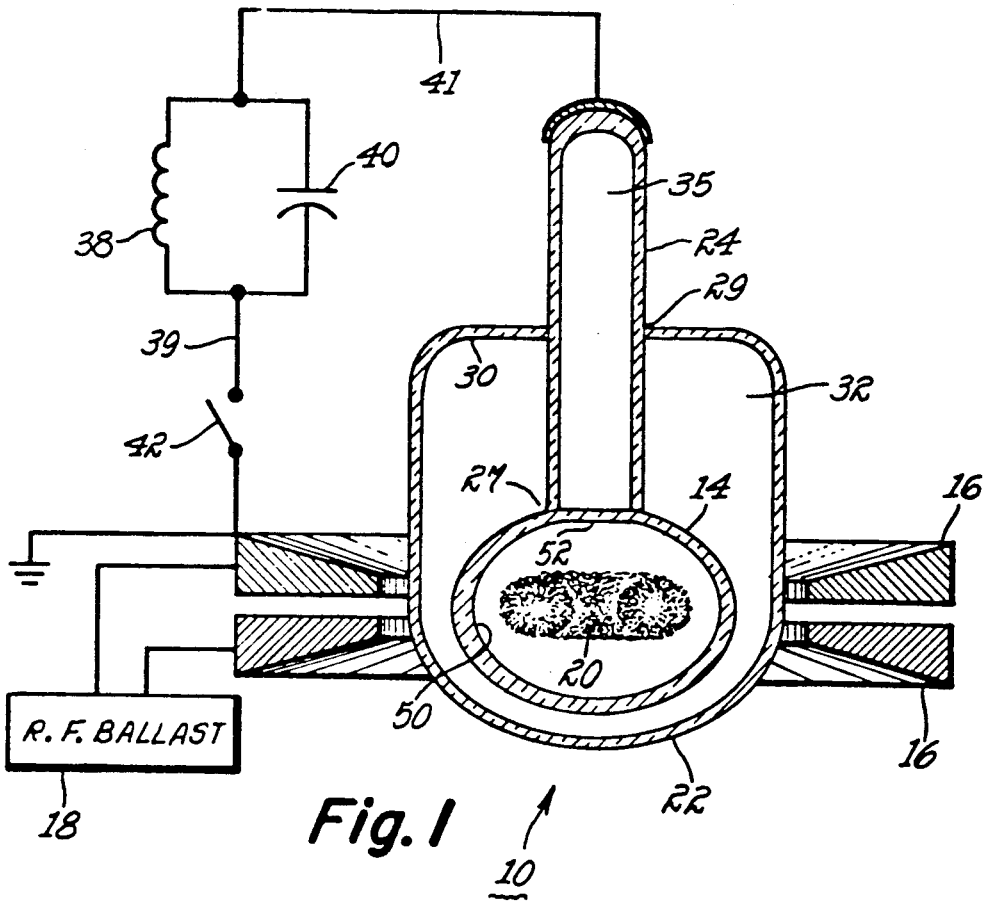
FIG. 1 is a partially schematic and partially sectional view of an electrodeless lamp embodying one form of our invention.

Referring first to FIG. 1, the electrodeless lamp 10 shown therein comprises an arc tube 14 having its walls formed, preferably, of a high temperature glass, such as fused quartz, or an optically transparent or translucent ceramic, such as polycrystalline alumina. An excitation coil 16 surrounds the arc tube and is coupled to a radio frequency (RF) ballast 18 for exciting a toroidal arc discharge 20 in the arc tube. By way of example, arc tube 14 is shown as having a substantially ellipsoidal shape. However, arc tubes of other suitable shapes may sometimes be desirable, depending upon the n, and are comprehended by our invention. For example, the arc tube may be substantially spherical or may have the shape of a short cylinder, or "pillbox", having rounded edges. An arc tube of the latter configuration is shown and described in U.S. Pat. No. 4,810,938, Johnson et al, referred to in more detail in the next paragraph hereof. Arc tube 14 contains a fill in which the above-mentioned arc discharge having a substantially toroidal shape is excited during lamp operation. A suitable fill is described in U.S. Pat. No 4,810,938 of P. D. Johnson, J. T. Dakin and J. M. Anderson, issued on Mar. 7, 1989, and assigned to the instant assignee. The fill of the Johnson et al patent comprises a sodium halide, a cerium halide and xenon combined in weight proportions to generate visible radiation and exhibiting high efficacy and good color rendering capability at white color temperatures. For example, such a fill according to the Johnson et al patent may comprise sodium iodide and cerium chloride, in equal weight proportions, in combination with xenon at a room temperature partial pressure of about 500 torr. Another suitable fill is described in the copending U.S. patent application of H. L. Witting, Ser. No. 348,433, filed May 8, 1989, and assigned to the instant assignee, which patent application is hereby incorporated by reference. The fill of the Witting application comprises a combination of a lanthanum halide, a sodium halide, and xenon or krypton as a buffer gas. A specific example of a fill according to the Witting application comprises a combination of lanthanum iodide, sodium iodide, cerium iodide and 250 torr partial pressure of xenon at room temperature. Another suitable fill is one comprising a combination of sodium iodide, cerium iodide and 250 torr partial pressure of krypton at room temperature.

As illustrated in FIG. 1, RF power is applied to the HID lamp by RF ballast 18 via excitation coil 16 coupled thereto. Excitation coil 16 is illustrated as comprising a two-turn coil having a configuration such as that described in the commonly assigned, copending U.S. patent application of G. A. Farrall, Ser. No. 493,266, filed Mar. 14, 1990, which patent application is hereby incorporated by reference. Such a coil configuration results in very high efficiency and causes only minimal light blockage from the lamp. The excitation coil of the Farrall application comprises one or more turns connected in series. The shape of each turn is generally formed by rotating a bilaterally symmetric trapezoid about a coil center line situated in the same plane as the trapezoid, but which line does not intersect the trapezoid, and providing a cross-over means for connecting the turns. However, other suitable coil configurations may be used with the starting aid of the present invention, such as that described in commonly assigned U.S. Pat. No. 4,812,702 of J. M. Anderson issued Mar. 14, 1989, which patent is hereby incorporated by reference. In particular, the Anderson patent describes a coil having six turns which are arranged to give the coil a substantially V-shaped cross section on each side of the coil center line. Still another suitable excitation coil may be of solenoidal shape, for example.

In operation, RF current in coil 16 results in a time-varying magnetic field which produces within arc tube 14 an electric field that substantially closes upon itself. Once the lamp is started, as will soon be described, current flows through the fill within arc tube 14 as a result of this solenoidal electric field, producing the toroidal arc discharge 20 in the fill. Suitable operating frequencies for RF ballast 18 are in the range from 0.1 to 300 megahertz (MHz), an exemplary operating frequency being 13.56 MHz.

A suitable ballast 18 is described in commonly assigned, copending U.S. patent application of J. C. Borowiec and S. A. El-Hamamsy, Ser. No. 472,144, filed Jan. 30, 1990, which patent application is hereby incorporated by reference. The lamp ballast of the cited patent application is a high-efficiency ballast comprising a Class-D power amplifier and a tuned network. The tuned network includes an integrated tuning capacitor network and heat sink. In particular, two capacitors, the first in series combination and the second in parallel combination with the excitation coil, are integrated by sharing a common capacitor plate. Furthermore, the metal plates of the parallel tuning capacitor comprise heat conducting plates of a heat sink used to remove excess heat from the excitation coil of the lamp.

The arc tube 14 of FIG. 1 is enclosed within an outer envelope 22, preferably of quartz, that serves to reduce heat loss from the arc tube, absorb ultraviolet radiation from the toroidal arc discharge within the arc tube, and protect the arc tube walls from harmful surface contamination. The arc tube is also supported from the outer envelope 22 by means of hollow stem 24 of elongated tubular configuration. In a preferred form of the invention, the arc tube wall is of quartz and the stem 24 is of quartz tubing butt-joined through fusion to the outer surface of the quartz arc tube wall. In the localized region 27 where the quartz tubing is joined to the quartz arc-tube wall, the portion 52 of the arc-tube wall is substantially flat on both its outer surface and on its inner surface. In a location 29, spaced along the stem 24 from the region 27, the stem 24 extends through an opening in the top wall 30 of the outer envelope 22 an is fused about the outer periphery to the top wall to form a vacuum-tight seal. The space 32 between the outer envelope 22 and the arc tube 14 is evacuated so as to provide thermal insulation for reducing heat loss from the arc tube.

The upper end of the stem 24 is sealed off so that within the stem there is a closed chamber 35. This chamber is filled with a gas that has a substantially lower dielectric strength than that of the gaseous fill located within the arc tube 14, considered under the normal conditions prevailing just prior to start-up of the lamp 10. This gas that fills chamber 35 can be the same gas as present in the arc tube 14 but at a lower pressure than the gas present in the arc tube, e.g., at a pressure of about 1/10 of that of the arc tube. Alternatively, the gas in chamber 35 may be a different gas which can be broken down by an easily-developed and handled high voltage. Examples of specific gases usable in the chamber 35 are krypton, xenon, neon, argon, helium, and mixtures thereof. In each case, the pressure of this fill should be low enough to impart a dielectric strength to the gas below that of the gas within arc tube 14. In our specific embodiment, we use for the fill in chamber 35 pure krypton at a room-temperature pressure of 20 torr. A specific example of a gas mixture that is advantageously usable is a Penning mixture consisting of a mixture of neon and argon.

The stem, or container, 24 and the gas within its chamber 35 may be thought of as being part of a starting aid for assisting in the development of the toroidal arc discharge 20 in arc tube 14. As will soon appear more clearly, a significant feature of our lamp is that the starting container, or stem, 24 has one end wall (its lower end wall) which is constituted by a part of the wall portion 52 of the arc tube 14.

Our starting aid further comprises means for developing and applying a high voltage to initiate breakdown in hollow stem 24 and subsequently in chamber 14. This means, schematically illustrated in FIG. 1, comprises the parallel combination of an inductor 38 and a capacitor 40 connected between a ground potential point on the upper turn of excitation coil 16 and the upper end of the starting container 24 via conductors schematically shown at 39 and 41. A suitable switch 42 connected in series with the parallel combination can be closed to connect the parallel combination across the source through the stray capacitance of the lamp and can be opened to interrupt the circuit that connects the parallel combination across the source. Additional details of the voltage developing and applying means 38–42 are disclosed in commonly-assigned Applications Ser. No. 07/622,024 Cocoma et al and U.S. Pat. No. 5,057,750 issued to Farrall et al on Oct. 15, 1991 which application and patent are hereby incorporated by reference herein. The L-C circuit 38, 40 is tuned so that it is in a condition of approximate resonance when energized by the 13.56 MHz RF current of ballast 18. When a high voltage is developed across the L-C circuit 38, 40 by the RF current from ballast 18, a corresponding high voltage is applied across the length of starting container 24 and also across the length of the column of gas in chamber 35 of the starting container. This high voltage is sufficient to produce a dielectric breakdown across this length of gas in chamber 35; and this breakdown develops . into a discharge that extends along the entire length of the chamber 35. This discharge, through which capacitive current flows, is shown at 45 in FIG. 2, where the lamp is shown in a condition that we refer to as the initial breakdown stage.

Figure 2:
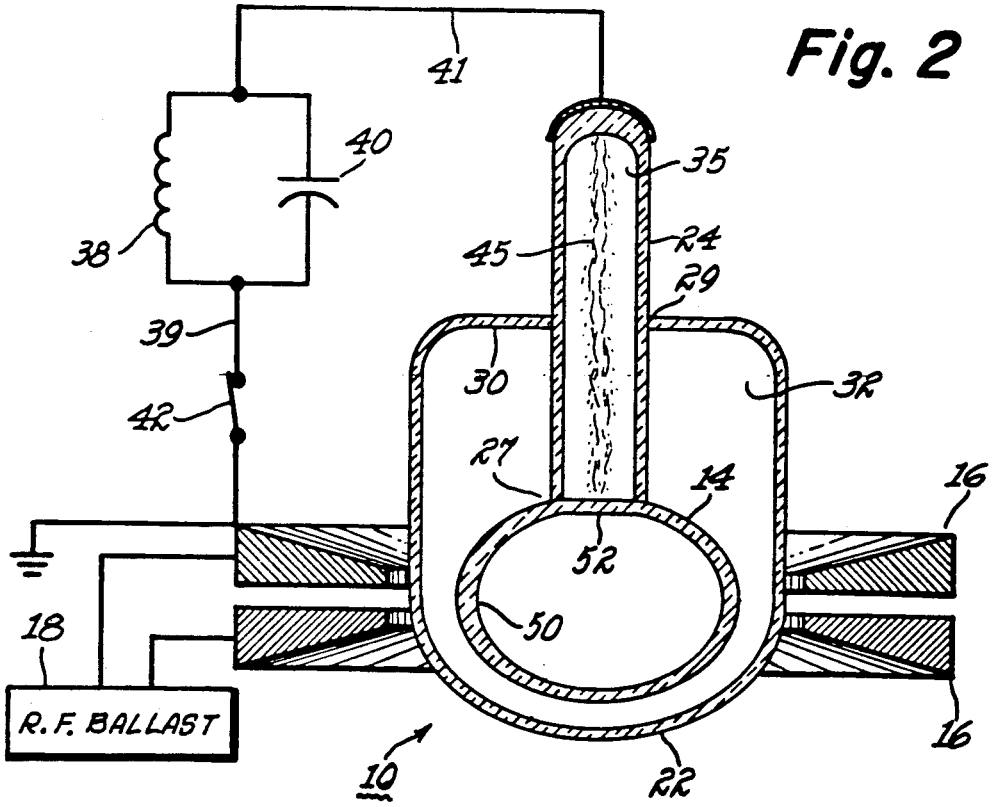
FIG. 2 is a view similar to that of FIG. 1 except showing the lamp during an initial breakdown stage early in a startup operation.

The discharge 45 of FIG. 2, like the toroidal arc 20 of FIG. 1, is an electrodeless arc. But a basic difference between these two arcs is that the arc 45 is capacitively coupled to its power source 18, 38–42, whereas the toroidal arc 20 is inductively coupled to its power source 18, 16.

Just prior to the initial breakdown stage depicted in FIG. 2, and while the excitation coil 16 is energized, the upper wall portion 52 of the arc tube and the equatorial wall portion 50 of the arc tube are at relatively low potentials determined primarily by the average potential of the excitation coil 16, the upper turn of which is at ground potential. Any potential difference present between these two wall portions 50 and 52 at such time is relatively small and not great enough to cause a dielectric breakdown between these wall portions since they are separated by the relatively high-dielectric-strength fill gas in arc tube 14.

Figure 3:
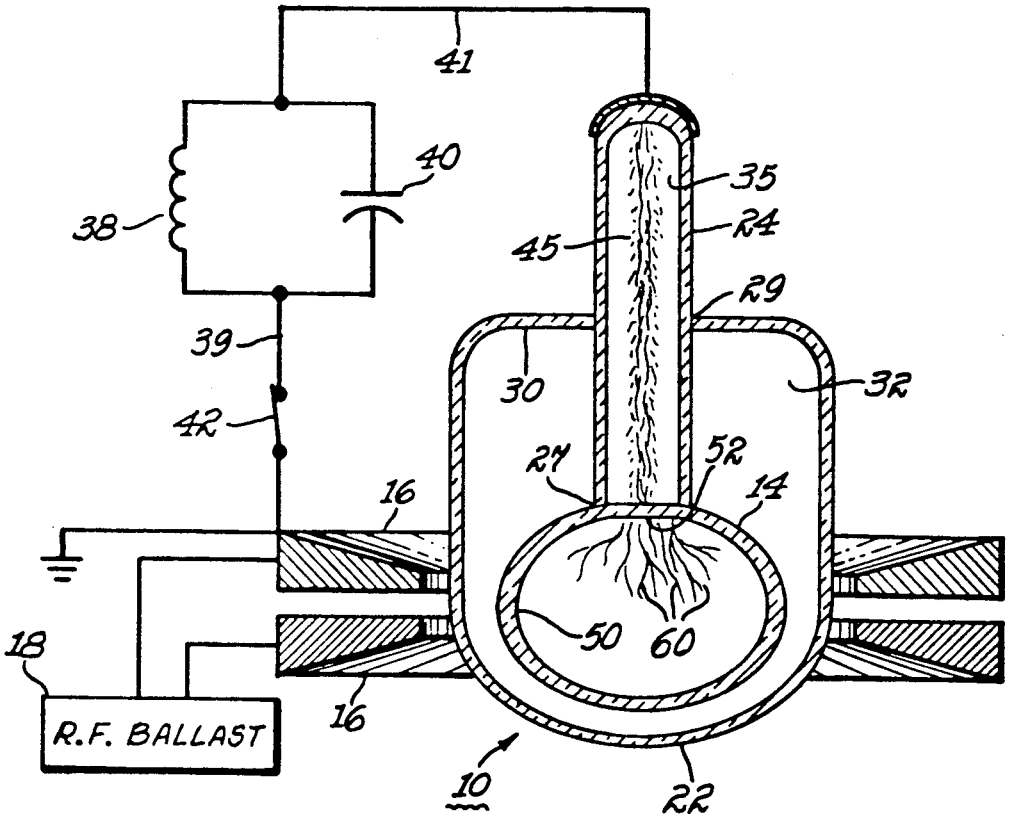
FIG. 3 is a view similar to that of FIG. 1 except showing the lamp in a transfer stage that occurs immediately following the stage depicted in FIG. 2 but immediately prior to the start of the operating mode depicted in FIG. 1.

Just prior to the initial breakdown stage depicted in FIG. 2, a relatively high voltage with respect to ground is developed across the L-C circuit 38, 40. This voltage is an RF voltage appearing at the top of the starting container 24, whereas the bottom of the starting container 24 is then at substantially ground potential. When the above-described dielectric breakdown occur in the chamber 35 and develops into the discharge 45, the potential that is applied to the starting container 24 is connected through discharge 45 (which acts as a low impedance conductor) to the wall portion 52 of the arc tube at the bottom terminal of the discharge. The result is that the potential of this wall portion 52 quickly increases to a high level near that of the applied voltage thereby increasing the voltage present between arc-tube wall portions 52 and 50 by a large amount. Immediately thereafter, as shown in FIG. 3, filamentary discharges 60 appear within the arc tube 14, emanating from the wall portion 52.

These filamentary discharges 60 represent a dielectric breakdown of the gaseous fill within the arc tube 14. This dielectric breakdown allows the electric and magnetic fields then being generated by RF current through the excitation coil 16 to develop a toroidal arc discharge of the form shown at 20 in FIG. 1. Thereafter, these electric and magnetic fields are capable of maintaining the toroidal arc discharge without assistance from the starting discharge 45. Accordingly, the starting discharge is then extinguished in a suitable manner, e.g., by opening the switch 42 to interrupt the circuit 43 and thereby disconnect the discharge 45 from its power source.

It will be apparent from the above that because the lower end wall of the starting container 24 is constituted by a portion 52 of the arc tube, the same potential will be present at the lower end wall of the starting container and at the wall portion 52 of the arc tube. Accordingly, when discharge 45 is developed as above described, it transfers to the arc tube wall portion 52 the same potential as it transfers to the end wall of the starting container.

As pointed out hereinabove, the inner surface of the arc tube in the region 52 where the filamentary discharges 60 emanate is substantially flat. This feature has proven to be significant because if the construction in this region is such that the stem 24 protrudes into the arc tube, it has been found that the protruding tip of the stem is subject to overheating and resultant failure. On the other hand, designs which result in local cavities in this region are problematic because these cavities serve as condensation sites for halides in the gaseous fill.

Another significant feature of our lamp is that the relevant portion of its starting container, or stem, 24 is smaller in transverse cross-section than is the relevant portion of the arc tube. The relevant portion of the arc tube is the hollow portion thereof that extends about the outer periphery of the toroidal discharge 20, and this hollow portion has an average cross-sectional area which is large in comparison to the transverse cross-sectional area of the starting container in its relevant region, i.e., the region of the starting container immediately adjacent its end wall. Keeping the cross-sectional area of the starting container relatively small in this region is important because it prevents an inductively coupled, or toroidal, discharge from developing in the starting container 24 under the influence of the magnetic and electric fields present therein (as a result of RF current through excitation coil 16). The lamp can sustain only one inductively coupled, or toroidal, arc discharge at any one time, and if such an inductively coupled discharge develops in the starting container or anywhere else in the lamp outside the arc tube, its presence will prevent such an inductively-coupled discharge from developing within the arc tube 14, where it is intended.

While we have shown in our drawings a tubular starting container 24 that is of a simple straight-line configuration, it is to be understood that our invention in its broader aspects comprehends other configurations, such as a tubular member of curved form or a tubular . member with a bend in it.

Figure 4:
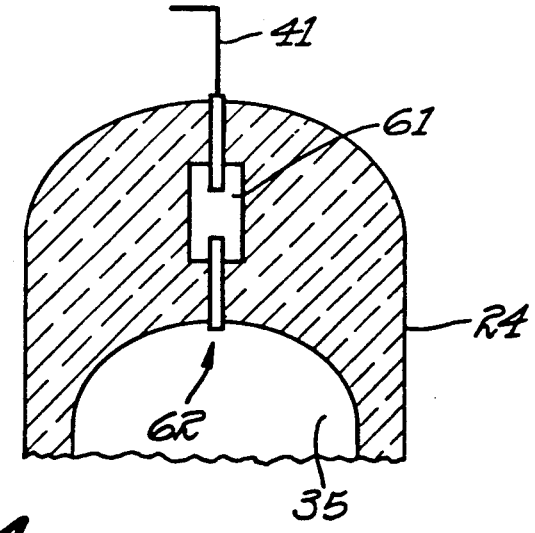
FIG. 4 is an enlarged sectional view of a portion of a lamp embodying a modified form of our invention.

It is also to be understood that our invention in its broader aspects may include additional means for initiating a breakdown in the starting container, or stem, 24. Other suitable means may be used for this purpose. For example, an electrode (such as shown at 62 in FIG. 4) may be incorporated into the top end of the starting container 24 and high voltage applied to this electrode to initiate a breakdown of the gaseous fill in the starting container. In the FIG. 4 embodiment the electrode 62 is shown connected to the conductor 41 of FIGS. 1-3 to enable it to receive energizing voltage from means 38-42 of FIGS. 1-3. A conventional foil type seal 61 is provided where the electrode passes through the quartz tubing. Of course, other suitable high voltage sources instead of that shown may be used for applying a starting high voltage to electrode 62. Even though an electrode such as 62 is present in the starting container of FIG. 4, the lamp itself is still considered to be an electrodeless lamp inasmuch as there would still be no electrode for the main arc, i.e., the toroidal arc within arc tube 14. A related application on starting means of the general type described in this paragraph is commonly-assigned, concurrently-filed Application Ser. No. 07/622,247 - Roberts et al, which is incorporated by reference herein.

Figure 5:
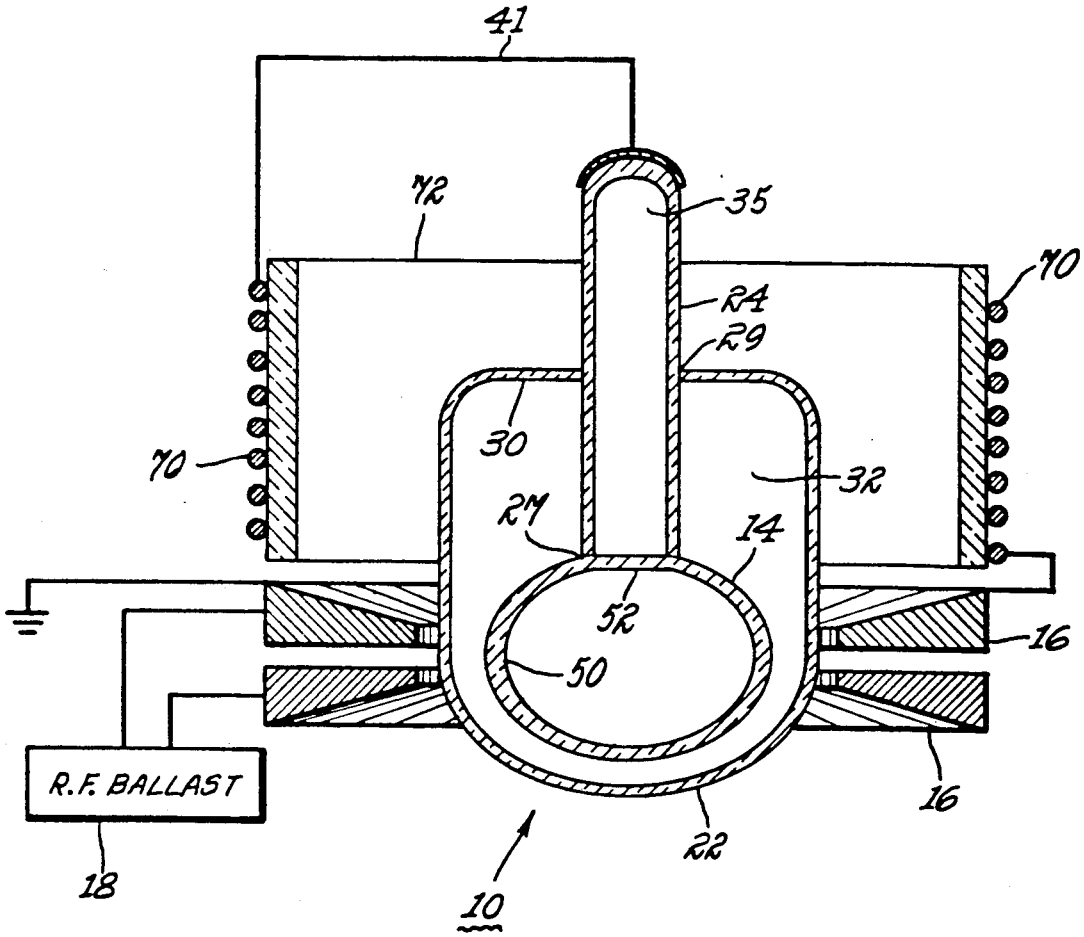
FIG. 5 is a view similar to that of FIG. 1 showing a modified electrodeless lamp embodying another form of our invention.

It is also to be understood that our invention in its broader aspect is not limited to the specific means shown at 38-42 for supplying voltage to the starting container or stem 24. For example, another way of initiating a breakdown is to utilize for this purpose the induced electric field from a suitably configured secondary coil, which in combination with the main excitation coil forms a transformer. When this transformer is energized by the above-described radio frequency current, the resulting electric field establishes a relatively high potential at the upper end of the stem 24 and a sufficiently high electric field within the gas inside the stem to cause a discharge between the two ends of the stem. A device relying upon this approach is shown in FIG. 5, which uses the same reference numerals as appear in FIG. 1 to designate corresponding components. The above-noted secondary coil is shown at 70. This secondary coil 70 is wound around a tube 72 of vitreous material, such as quartz or Pyrex glass, which surrounds the portion of the lamp above the main excitation coil 16. The secondary coil is electrically connected at its lower end to the upper turn of the main excitation coil 16 and at its upper end is connected through conductor 41 to the upper end of the starting container 24. This secondary coil 70 in combination with the main excitation coil 16 forms an autotransformer which, when energized by suitable RF current through coil 16, acts as above described to cause a discharge in the starting container. The vitreous tube 72 spaces the secondary coil a relatively large distance from the arc tube 14.

It will be apparent from the above description that our starting means does not rely upon metal electrodes, metal probes, or similar metal parts positioned near or within the arc tube. This enables us to eliminate most of the life-limiting problems associated with metallic starting aids and also enables us to eliminate the need for any mechanism for withdrawing such metal parts after starting While our starting means, like a metallic starting aid, does initiate arcing within the arc tube by increasing or concentrating the electric field therein, this is done not by positioning metal parts adjacent or within the arc tube but by using an electric discharge for transferring high potential from a remote point to a portion of the arc tube wall. Any metal parts that we utilize to assist in starting are located not adjacent to the arc tube but rather adjacent to a secondary chamber that contains a fill that is isolated from the fill in the arc tube and more easily broken down than the fill within the arc tube.

While we have described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim is:

1. An electrodeless high intensity discharge lamp comprising:

(a) a light-transmissive arc tube having spaced wall portions of dielectric material and a first gaseous fill within said arc tube, (b) an excitation coil disposed about said arc tube and energizable with radio frequency current effective to develop a toroidal arc discharge in said first gaseous fill upon a dielectric breakdown of said first gaseous fill, (c) a starting container primarily of dielectric material joined to said arc tube and having an end wall that is constituted by one of said arc-tube wall portions of dielectric material, (d) a second gaseous fill within said starting container having a dielectric strength lower than that of said first fill under normal conditions prevailing immediately prior to start-up of said lamp, (e) means for initiating said toroidal arc discharge in said arc tube comprising means for producing a dielectric breakdown of the gaseous fill within said starting container that develops into a discharge within said starting container that changes the potential at said end wall by an amount to increase the voltage present between said arc-tube wall portions sufficiently to trigger a dielectric breakdown of said first gaseous fill and (f) wherein said means for producing a dielectric breakdown of the gaseous fill within said starting container comprises a second coil connected between a point on said excitation coil and a point on said starting container to form in combination with said excitation coil a transformer for developing a voltage across said second gaseous fill that is effective to breakdown said second gaseous fill upon energization of said transformer prior to initiation of said toroidal discharge in said arc tube.

2. An electroless high intensity discharge lamp comprising:

(a) a light-transmissive arc tube having spaced wall portions of dielectric material and a first gaseous fill within said arc tube, (b) an excitation coil disposed about said arc tube and energizable with radio frequency current effective to develop a toroidal arc discharge in said first gaseous fill upon a dielectric breakdown of said first gaseous fill, (c) a starting container primarily of dielectric material joined to said arc tube and having an end wall that is constituted by one of said arc-tube wall portions of dielectric material, (d) a second gaseous fill within said starting container having a dielectric strength lower than that of said first fill under normal conditions prevailing immediately prior to start-up of said lamp, (e) means for initiating said toroidal arc discharge in said arc tube comprising means for producing a dielectric breakdown of the gaseous fill within said starting container that develops into a discharge within said starting container that changes the potential at said end wall by an amount to increase the voltage present between said arc-tube wall portions sufficiently to trigger a dielectric breakdown of said first gaseous fill and (f) wherein said means for producing a dielectric breakdown of the gaseous fill within said starting container comprises a second coil inductively coupled to said first coil so as to form in combination with said first coil a transformer for developing a voltage across said second gaseous fill that is effective to break down said second gaseous fill upon energization of said excitation coil prior to initiation of said toroidal discharge in said arc tube, said excitation coil acting as the primary winding and said second coil acting as the secondary winding of said transformer.

3. The lamp of claim 1 in which a tube of vitreous material is provided about a portion of said lamp and said second coil is wound about said tube.

4. The lamp of claim 2 in which a tube of vitreous material is provided about a portion of said lamp and said second coil is wound about said tube.

* * * * *